United States Patent [19]

Gould

[11] 4,304,165

[45] Dec. 8, 1981

[54] CAPODASTRO

[76] Inventor: Terence Gould, The Old Crown, Bugbrooke, Northampton, England, NN7 3RF

[21] Appl. No.: 143,280

[22] Filed: Apr. 24, 1980

[30] Foreign Application Priority Data

Apr. 27, 1979 [GB] United Kingdom ..... 14805/79

[51] Int. Cl.[3] ..... G10D 3/04

[52] U.S. Cl. ..... 84/318

[58] Field of Search ..... 84/318

[56] References Cited

U.S. PATENT DOCUMENTS 3,277,765 10/1966 Miller et al. ..... 84/318

4,128,034 12/1978 Myerson et al. ..... 84/318

FOREIGN PATENT DOCUMENTS 1048545 11/1966 United Kingdom ..... 84/318

*Primary Examiner*—Lawrence R. Franklin

[57] ABSTRACT

A capodastro for stringed musical instruments, has a pressure bar C, and a strap D. Lower face L of bar C has two roughly parallel long edges. Edge I is straight, and edge K is vertically concave. The concavity at edge K complements the maximum convexity normally found transversely on the fingerboards of stringed musical instruments. The longitudinal contour lines of face L increase in curvature gradually from straight edge I to curved edge K. In one version face L is smooth. In a second version face L bears any number of longitudinal ridges M. The lower face L of pressure bar C is thus adapted to press equally on all the strings whether the fingerboard be flat or convex.

2 Claims, 5 Drawing Figures

CAPODASTRO

A capodastro is sometimes called a capotasto or simply a capo. It is a device used by the players of stringed musical instruments, and is comparable to a clamp which may be mounted around the neck of the instrument at any desired position and which presses the strings onto the fingerboard for the purpose of enabling the player to play in a variety of keys while employing the same fingering A capodastro normally has two main constituent parts. Firstly it has a bar which when the capodastro is in use upon the instrument presses the strings onto the fingerboard. Secondly a strap or other means of maintaining the bar in position is normally provided, which strap passes around the neck of the instrument and has fastening means to facilitate the mounting of the capodastro upon and its detachment from the neck.

Some stringed instruments have fingerboards with flat surfaces, and some have fingerboards with transversely convex surfaces. The degree of curvature of a convex fingerboard, while not great, is sufficient to preclude the maintenance of equal pressure over all the strings by a capodastro the bar of which is straight.

Players possessing both kinds of instruments normally employ a separate capodastro for each kind, one having a curved bar for the convex fingerboard instrument, and one having a straight bar for the flat fingerboard instrument.

The principal object of my invention is to provide a capodastro with a bar which is adapted to be effective in an improved manner both on instruments having a flat fingerboard, and also upon instruments having a convex fingerboard.

The following description relates to the accompanying drawing, wherein

Referring more particularly to the drawings

Figure 1:
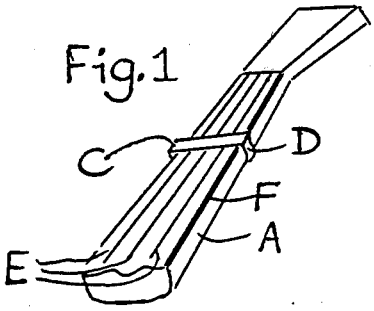
FIG. 1 is a view in perspective of part of the neck of a stringed musical instrument with a capodastro mounted in position.

Part of the neck A of a musical instrument is shown in perspective in FIG. 1, having fingerboard F and strings E. A capadastro is mounted in place, having bar C and strap D.

Figure 2:
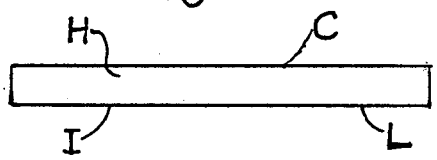
FIG. 2 is a view in elevation of one long side of the bar of my capodastro.
Figure 3:
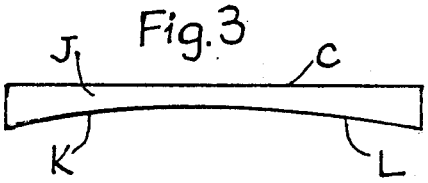
FIG. 3 is a view in elevation of the opposite side of the bar.
Figure 4:
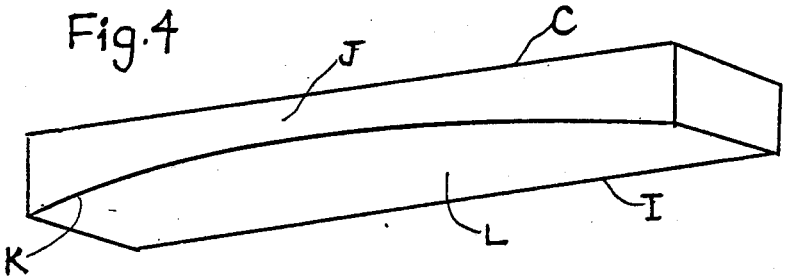
FIG. 4 is a view in perspective of the bar in its first version.
Figure 5:
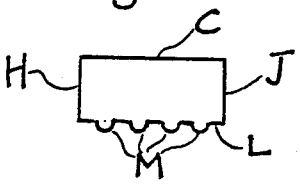
FIG. 5 is a view in elevation of one short end of the bar, illustrating an optional modification.

My invention concerns bar C, of which a preferred embodiment is shown in FIGS. 2, 3 and 4. A second version is illustrated in FIG. 5.

In FIG. 2 an elevation is shown of one long side H of bar C. Edge I of lower face L of bar C is straight. When my capodastro is mounted on a flat fingerboard edge I presses equally on all strings. Opposite long side J, which is roughly parallel to side H, is shown in elevation in FIG. 3. Edge K of lower face L is vertically concave. When mounted on a convex fingerboard edge K presses equally upon all the strings.

The concave configuration of edge K is such that it conforms to the maximum degree of convexity normally found in stringed instrument fingerboards.

The perspective view of bar C given in FIG. 4 shows lower face C to be smooth. The degree of concavity of face L increases gradually and evenly from straight edge I to curved edge K.

The bar may be modified, as shown in FIG. 5, by the provision of any number of longitudinal ridges M on face L.

Bar C is demonstrated above to be adapted to be equally effective on all fingerboards, whether they are flat, only slightly convex, or whether they have maximum convexity.

Bar C may be made of any convenient material or combination of materials, which may be wood with a soft layer of leather or rubber on the lower face, or it may be a moulding of thermoplastic or thermosetting material which may be supported by a rigid member to maintain its configuration.

Strap D may be a strip of flexible material, attached at each end to the opposite ends of bar C, with attachment means.

A variety of means of mounting bar C onto the fingerboard may be used without departing from the spirit of my invention.

What I claim is:

1. A capodastro for stringed musical instruments having a pressure bar which is adapted to be effective on both flat fingerboards and on fingerboards having a transverse convexity with a range of curvature up to a maximum, the pressure bar having a lower face with two generally parallel long edges one of which edges is straight and the other of which edges has a vertical concave curvature to complement a fingerboard convexity of said maximum curvature, the longitudinal contour lines of which lower face decrease progressively in curvature from the concave edge to the opposite straight edge.

2. A capodastro for stringed musical instruments having a pressure bar as in 1, where the lower face of the pressure bar bears any number of longitudinal ridges.

* * * * *